United States Patent [19]

Babler et al.

[11] 4,200,408

[45] Apr. 29, 1980

[54] WINDROW PICKUP ATTACHMENT FOR ASPHALT PAVEMENT LAYING APPARATUS

[75] Inventors: Richard G. Babler, Milwaukie; George V. Stinchfield, Candy; Melvin W. Kannard, Portland, all of Oreg.

[73] Assignee: Babler Bros., Inc., Portland, Oreg.

[21] Appl. No.: 960,238

[22] Filed: Nov. 13, 1978

[51] Int. Cl.[2] ..... E01C 19/00

[52] U.S. Cl. ..... 404/83; 37/102; 198/316; 198/318; 298/7

[58] Field of Search ..... 404/92, 91, 101, 75, 404/83; 198/312, 314, 315, 316, 318; 37/102; 298/7

[56] References Cited

U.S. PATENT DOCUMENTS

| | | | |
|---|---|---|---|
| 1,258,299 | 3/1918 | Bayley | 404/101 X |
| 1,345,172 | 6/1920 | Haiss | 404/101 X |
| 1,764,084 | 6/1930 | Nelson . | |
| 1,987,398 | 1/1935 | Gardiner . | |
| 2,064,807 | 12/1936 | Barber | 404/92 |
| 2,114,078 | 4/1938 | Jackson | 404/92 |
| 2,201,493 | 5/1940 | Jorgensen | 404/92 |
| 2,589,256 | 3/1952 | Horning | 404/101 X |
| 2,618,083 | 11/1952 | Armington . | |
| 2,627,680 | 2/1953 | Schulte . | |
| 2,672,701 | 3/1954 | Blocker . | |
| 3,103,754 | 9/1963 | Wieger . | |
| 3,308,563 | 3/1967 | Danek . | |
| 3,361,042 | 1/1968 | Cutler | 404/92 X |
| 3,479,755 | 11/1969 | Schropp | 404/101 X |
| 3,693,512 | 9/1972 | Smith | 404/101 |
| 3,885,332 | 5/1975 | Holland | 37/102 |
| 3,982,338 | 9/1976 | Dick | 37/102 |
| 4,011,023 | 3/1977 | Cutler | 404/91 |
| 4,027,428 | 6/1977 | Hillel | 47/58 |

*Primary Examiner*—Nile C. Byers, Jr.
*Attorney, Agent, or Firm*—Eugene D. Farley

[57] ABSTRACT

A windrow pickup attachment for asphalt pavement laying apparatus provided with a feed hopper for receiving soft asphalt aggregate laid in a windrow in front of the apparatus. The attachment comprises an upwardly inclined chute hinged to a low lying hopper front wall and a flight conveyor overlying both chute and hopper. The flight conveyor is hinged to a relatively elevated hopper back wall. Skids support the lower forward end of the chute on the pavement. A chute conveyor support supports the lower forward end of the chute conveyor on the chute. Drive mechanism pivotally attached to the forward portion of the chute reciprocates the same, and hence the chute conveyor resting thereon, between lowered working and raised transport positions.

8 Claims, 3 Drawing Figures

WINDROW PICKUP ATTACHMENT FOR ASPHALT PAVEMENT LAYING APPARATUS

BACKGROUND AND GENERAL STATEMENT OF THE INVENTION

This invention relates to a windrow pickup attachment for use in conjunction with asphalt paving apparatus comprising an asphalt aggregate spreading unit and associated feed hopper.

In the building of asphalt roads, it is usual practice for dump trucks to deliver the asphalt aggregate paving material to the site and lay it in an elongated windrow along the longitudinal center line of the road section to be built. The windrow is substantially continuous and may be two to three feet deep and about eight feet wide.

While the aggregate still is soft, the paving apparatus straddles and moves along the length of the windrow. This apparatus broadly comprises a pickup unit which picks up the asphalt from the windrow, a feed hopper which receives the soft aggregate from the pickup unit, and a spreading unit which receives the aggregate from the feed hopper and spreads it laterally to the appropriate dimension, for example, about 15 feet. It is important that the asphalt thus spread be of uniform thickness and have a smooth, uniform surface.

Prior art patents which are of interest in connection with the picking up of asphalt and other materials and laying or spreading them on a surface include the following:

U.S. Pat. Nos. 1,258,299; 1,764,084; 1,987,398; 2,618,083; 2,627,680; 2,672,701; 3,103,754; 3,308,563; 3,479,775; 3,693,512; 3,885,332; 3,982,338; 4,011,023; 4,027,428.

The conventional prior art asphalt windrow pickup attachment is a heavy piece of apparatus mounted on caster wheels secured by a bracket to the front end of the paver equipment which accordingly pushes the attachment ahead of it. The front end of the attachment is provided with side guides which straddle the windrow. An endless flight conveyor delivers the paving material from the windrow rearwardly into the front portion of the paving apparatus. Conventionally, the side guides and conveyor are secured together permanently so that neither of them can move vertically without the other.

The primary problem attending the use of the prior art asphalt aggregate pickup attachments of this class resides in the fact that the conveyor flights pound down on the top of the windrow and are severely bent or broken. Downward pounding of the conveyor flights also tends to lift the entire attachment off the ground with its wheels or other supporting structure spinning about erratically. This imparts considerable vibration to the structure and affects adversely the quality of the pavement laid with the apparatus.

It is the primary purpose of the present invention to provide a windrow pickup attachment for asphalt paving apparatus which overcomes the foregoing problem and which is characterized by the following important advantages:

It picks up the windrow cleanly and efficiently.

During use, its pickup conveyor component is not subject to damage.

It places the aggregate properly in the hopper so that the hopper can be loaded to full capacity and unloaded efficiently and completely.

It is of high capacity.

It adapts to conventional asphalt paving equipment and may be mounted thereon without major modifications of equipment structure.

It is characterized by proper weight distribution, i.e. it has most of its weight forwardly so that it picks up the aggregate cleanly.

It is of relatively light weight and correspondingly low cost.

In its use it is not necessary to lift the asphalt beyond a minimum elevation.

It is safe in use.

It does not affect adversely the steering of the paving unit, i.e. does not draw the unit to one side or the other.

It requires only one motor to lift both its major components, i.e. both chute and chute conveyor.

It adjusts to windrows of varying height.

It is characterized by substantially vibrationless operation with resulting laying of asphalt pavement having a smooth, non-wavy surface.

We have discovered that the foregoing objects of the invention may be achieved by the provision of a windrow pickup attachment for hopper-equipped asphalt aggregate spreading units which, broadly considered, comprises an upwardly inclined, longitudinally arranged chute communicating with the hopper, pivotal mounting means mounting the rearward end of the chute adjacent the top of the hopper front wall at a relatively low elevation, and ground engaging means supporting the forward portion of the chute on the ground. A hydraulic cylinder or other drive means pivotally attached to the forward portion of the chute, reciprocates it between lowered working and raised transport positions.

An elongated, longitudinally extending chute conveyor frame overlies the hopper and the chute. Pivotal mounting means mount the rearward end of the frame adjacent the relatively elevated top of the hopper back wall.

An upwardly inclined chute conveyor is mounted on the conveyor frame in the chute, substantially aligned with the hopper and arranged for driving aggregate up the chute and into the hopper. Chute conveyor support means on the lower end of the chute conveyor frame support the same on the chute in sliding, supporting engagement therewith. Accordingly reciprocation of the drive means secures operative angular movement of both the chute and the chute conveyor, despite the fact that these two pivoting elements of the apparatus are not hinged on a common axis.

DESCRIPTION OF PREFERRED EMBODIMENTS OF THE INVENTION

Figure 1:
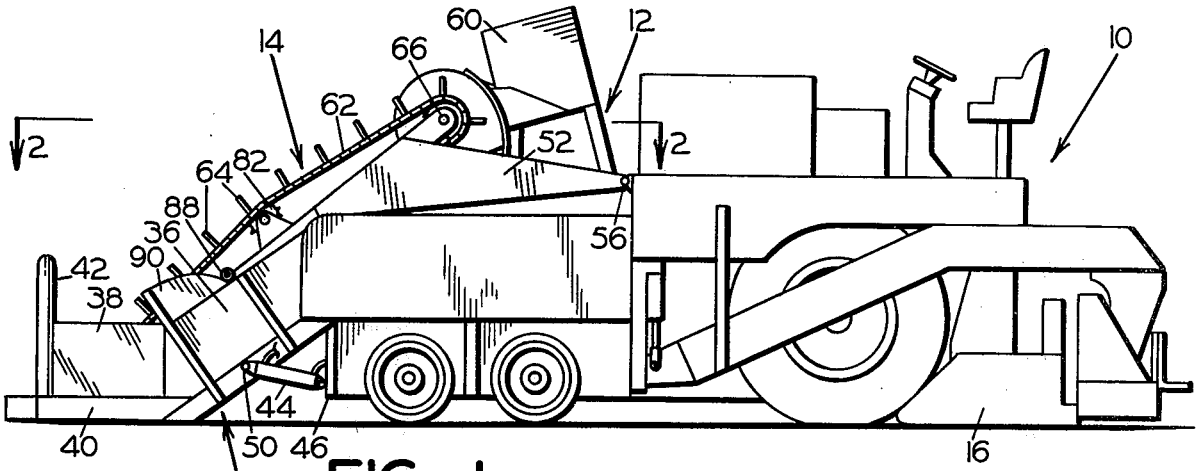
FIG. 1 is a side elevation of asphalt pavement laying apparatus including the asphalt aggregate windrow pickup attachment of the present invention.

As shown particularly in FIG. 1, the asphalt pavement laying apparatus with which the present invention is concerned broadly comprises an asphalt aggregate spreading unit, indicated generally at 10, a hopper assembly supplying the spreading unit with asphalt aggregate and indicated generally at 12, and a windrow pickup attachment used for filling the hopper and indicated generally at 14.

The asphalt aggregate spreading unit comprises a conventional self-propelled unit having an asphalt spreader 16 which spreads the soft aggregate to the desired width and depth.

Figure 3:
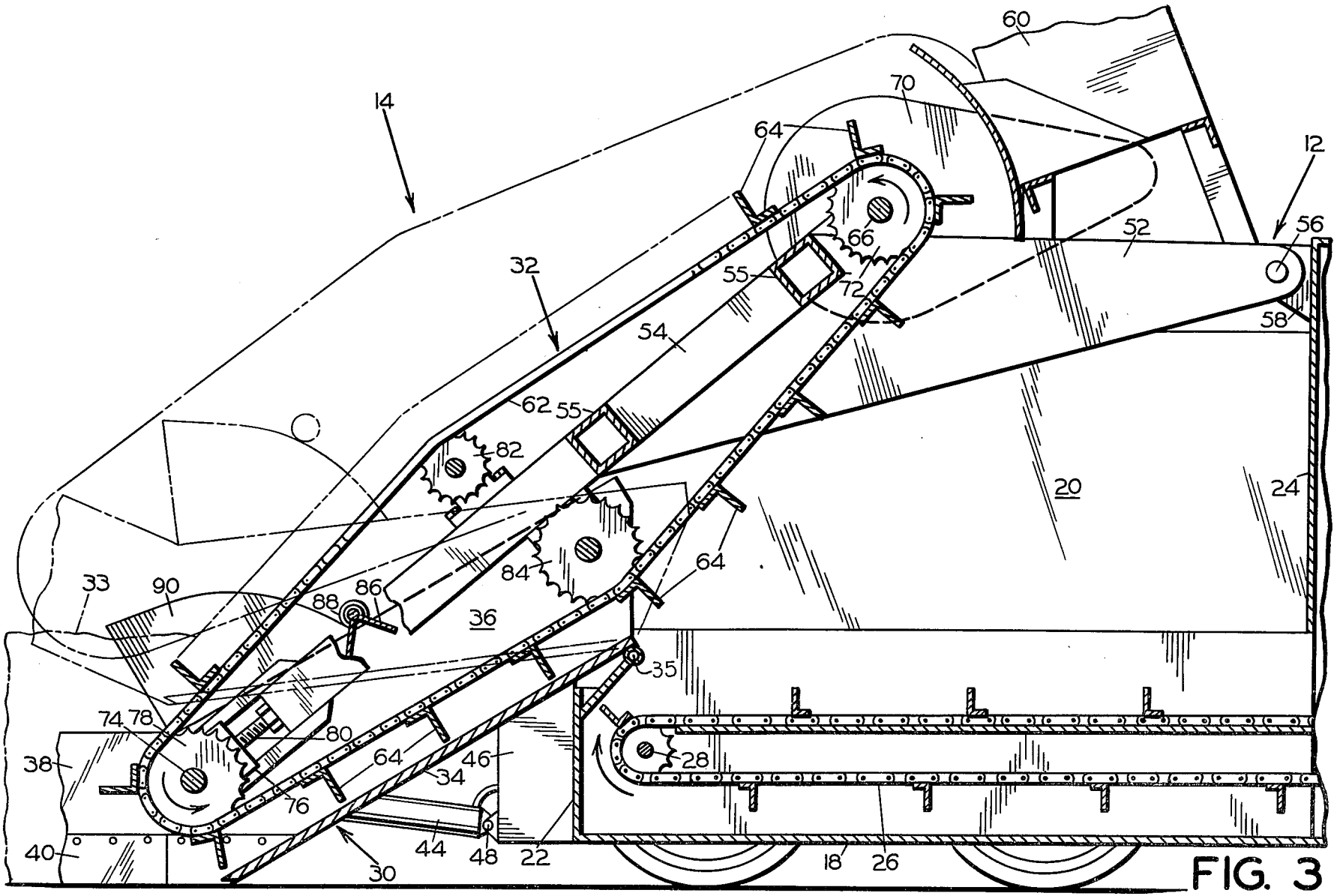
FIG. 3 is a longitudinal sectional view taken along line 3—3 of FIG. 2.

The hopper assembly 12 which supplies aggregate to the spreader comprises a wheeled unit which is attached to or integrated with the spreading unit. As seen in FIG. 3, its basic component parts are a floor 18, a pair of upstanding side walls 20, a relatively low front wall 22 and a relatively elevated back wall 24. The front wall is from 1/6 to ½ the height of the back wall. A pair of endless conveyors 26 are arranged side by side in parallel relation along the floor of the hopper. They are powered from a common drive shaft 28 and move the upper flight of the conveyor clockwise so that its upper flight transports aggregate from left to right, feeding it into the paving unit in known manner.

It is important, however, that the hopper be filled uniformly and in such a manner that it can be emptied efficiently by conveyors 26. It is to this end object among others that the herein described windrow pickup attachment 14 is directed.

Referring again to FIG. 3, it will be seen that the windrow pickup attachment basically comprises two sub-assemblies: A chute indicated generally at 30 and a chute conveyor, indicated generally at 32.

The chute sub-assembly is longitudinally arranged and includes a bottom 34 inclined upwardly so that its upper rearward end is but slightly above the top of front wall 22 of the hopper. The upper, rearward end of the chute is mounted pivotally adjacent the upper end of the front wall 22 by pivot shaft 35. Its lower forward end is spaced slightly from the ground or rests lightly thereon. It provides a ramp along which the aggregate is swept into the hopper, from windrow 33.

Chute 30 also includes a pair of vertically extending side walls 36 of substantial construction.

At their lower ends side walls 36 merge with outwardly flared guide plates 38 which guide the windrow into the chute. The lower margins of the guide plates mount skids 40 which support the forward end of the chute. A transverse guard rail 42, FIG. 1, is provided for personnel protection.

Drive means is provided for reciprocating the forward portion of the chute between lowered working and raised transport positions, i.e. between the full line and dashed line positions of FIG. 3.

The drive means provided for this purpose comprises one or a pair of fluid-actuated cylinders 44. The case of each cylinder is pivotally connected to a forward extension 46 of the hopper by means of pivot pin 48. The piston rod of each cylinder is pivotally connected to chute 30 by a pivot pin 50, FIG. 1.

The chute conveyor sub-assembly is mounted on an elongated, longitudinally extending chute conveyor frame which overlies both the hopper and the chute.

As shown particularly in FIG. 3, the frame comprises two similar frame members, one on each side of the hopper. Each frame member includes a substantially horizontal segment 52 which preferably consists of a heavy, vertical, flat plate.

Welded to the forward end of this plate is a substantial beam segment 54 which is arranged at an angle and inclines downwardly at an angle approximating the slope of the chute 30. Heavy cross braces comprising box frame members 55 strengthen the frame.

The upper end of the frame is pivotally mounted to hopper 12 adjacent the upper end of hopper back wall 24. It thus is displaced substantially, both horizontally and vertically, from the pivotal mounting of chute 30. This is required in order to achieve efficient filling of the hopper, and to place the weight of the unit rearwardly on skids 40.

The pivotal mounting means for the frame comprises a shaft 56 journaled in bearings supported on brackets 58 welded to the rearward wall 24 of the hopper.

A motor and drive assembly 60 is supported on frame members 52. Its weight assists in pressing the lower end of the unit downwardly.

The frame comprising horizontal and inclined segments 52, 54, respectively supports a chute conveyor having for its function driving asphalt aggregate up the chute and into the hopper. To this end the conveyor comprises an endless flight conveyor 62 having angle iron cross flights 64 constructed and designed to engage the asphalt and move it along the chute.

Pivotal mounting means are provided for pivotally mounting the upper end of the chute conveyor.

Figure 2:
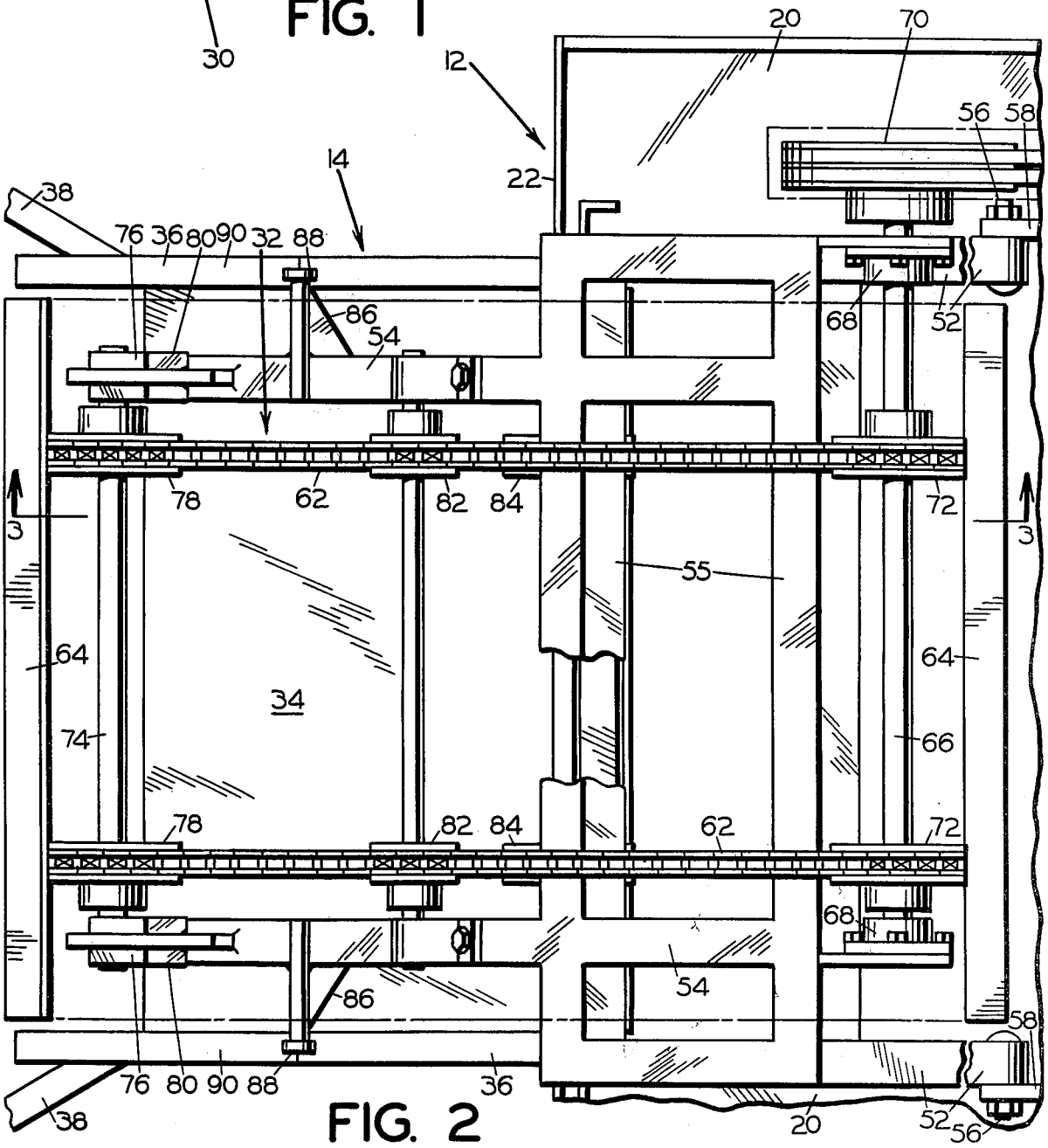
FIG. 2 is a fragmentary plan view looking in the direction of the arrows of line 2—2 of FIG. 1.

Thus, as shown in FIGS. 2 and 3, a drive shaft 66 is journaled in bearings 68 mounted on frame members 52. The drive shaft is rotated by means of a belt-and-pulley assembly 70. Conveyor chains 62 are driven by means of drive sprockets 72 fixed to the drive shaft.

The lower end of the chute conveyor is mounted on an idler sprocket assembly including idling shaft 74, bearings 76, and idler sprockets 78.

Proper positioning of the chute conveyor is achieved by means of a conveyor tightener 80, FIG. 3. It is also achieved by means of idler sprocket 82 mounted on the upper surface of frame members 54 and idler sprockets 84 mounted on the undersurface thereof. It will be observed that by this arrangement the lower flight of the conveyor is maintained precisely parallel to floor 34 of the chute, with flights 64 properly spaced therefrom.

Since the pivotal mountings for chute 30 and chute conveyor 32 are not on a common axis but are spaced substantially from each other, both horizontally and vertically, it is necessary to provide means for supporting the lower end of the chute conveyor for longitudinal positioning relative to the chute as the two elements of the assembly are moved upwardly and downwardly by cylinders 44.

This is accomplished by providing chute conveyor support means on the lower end of the chute conveyor frame in sliding, supporting engagement with the margins of the chute.

As shown particularly in FIG. 3, beams 54 constituting the lower, downwardly extending segments of the chute conveyor frame, mount a transverse support 86. The support rotatably mounts a pair of rollers 88. These in turn track on the upper margins of the chute side walls, in particular on upwardly extending, arcuately contoured, terminal guide segments 90 thereof. This makes possible relative longitudinal adjustment of the chute and the chute conveyor during the angular movement of these two elements.

OPERATION

The operation of the presently described asphalt aggregate windrow pickup attachment is as follows:

Referring to FIG. 1, assuming that trucks have laid a windrow 33 of soft asphalt aggregate in front of the apparatus, the operator on spreading unit 10 drives the entire assembly along the windrow. As he does so the soft aggregate is scooped up in chute 30, being guided by side wall guides 38 into the chute. The lower flight of chute conveyor 32 sweeps the aggregate up floor 34 of the chute and into hopper 12.

There the aggregate is deposited on conveyors 26 which convey it into spreading unit 10 which spreads the asphalt to the desired width and deposits it in the desired depth in known manner.

Since the lower end of chute conveyor 32 floats relative to the chute, it adjusts itself automatically to the thickness of the windrow, starting at the top and digging down into the windrow until the latter has been entirely transferred up the chute and into the hopper. This is accomplished cleanly and efficiently since the weight of the entire attachment lies forwardly of the hopper.

When it is desired to transport the unit to another location, extension of cylinders 44 raises both chute 30 and chute conveyor 32 to the dashed line position of FIG. 3 where they clear the ground, making it possible to move the unit. During elevation of these two sub-assemblies, rollers 88 traverse guide segments 90 on the chute conveyor frame, permitting longitudinal adjustment of the two sub-assemblies while at the same time maintaining them properly spaced.

Having thus described our invention in preferred embodiments, we claim:

1. In asphalt pavement laying apparatus including a longitudinally aligned asphalt aggregate spreading unit and a hopper arranged for feeding aggregate thereto, the hopper including a high back wall, a low front wall, and on its bottom a longitudinally extending conveyor, a windrow pickup attachment comprising in combination with the hopper:

(a) a chute mounted pivotally at its rearward end adjacent the upper end of the front wall of the hopper and extending longitudinally forward thereof, (b) drive means interengaging the chute and hopper for pivoting the chute between a lowered, working position for receiving asphalt aggregate from a windrow, and a raised, transport position, (c) an elongated conveyor frame mounted pivotally at its rearward end adjacent the upper end of the back wall of the hopper and extending forwardly thereof over the hopper and chute, (d) an elongated endless flight conveyor supported at its longitudinal ends on the conveyor frame for longitudinal movement relative thereto and including a plurality of longitudinally spaced transverse flight members, the lower working stretch of the conveyor being arranged for movement in the rearward direction relative to the chute for moving asphalt aggregate from a windrow rearwardly up the chute and into the hopper, and (e) conveyor support means on the conveyor frame arranged for releasable and movable engagement with the chute for supporting the forward portion of the frame freely by the chute and for limiting movement of the frame and conveyor toward the chute during movement of the chute between said working and transport positions and for allowing movement of the frame and conveyor freely toward and away from the chute as the flights engage a windrow of asphalt aggregate.

2. The windrow pickup attachment of claim 1 wherein the conveyor support means comprises rollers on the conveyor frame arranged for releasable rolling engagement with longitudinal roller guides on the chute.

3. The windrow pickup attachment of claim 2 wherein the roller guides are shaped to maintain the conveyor flights a predetermined distance from the chute during movement of the latter between said working and transport positions.

4. The windrow pickup attachment of claim 1 including conveyor drive means mounted on the conveyor frame forwardly of its pivotal mounting on the back wall of the hopper.

5. The windrow pickup attachment of claim 1 including laterally spaced side guide members on the chute diverging forwardly therefrom for directing asphalt aggregate from a windrow into the chute.

6. The windrow pickup attachment of claim 1 wherein the conveyor frame comprises a substantially horizontal segment overlying the hopper and a downwardly inclined segment overlying the chute.

7. The windrow pickup attachment of claim 6 wherein the endless conveyor is supported at its longitudinal ends at substantially the opposite ends of the downwardly inclined segment of the frame.

8. The windrow pickup attachment of claim 7 including conveyor drive means mounted on the substantially horizontal segment of the conveyor frame forwardly of its pivotal mounting on the rear wall of the hopper.

* * * * *